US008057268B2

(12) United States Patent
Seng et al.

(10) Patent No.: US 8,057,268 B2
(45) Date of Patent: Nov. 15, 2011

(54) RETAINING DEVICE FOR CABLE LUGS

(75) Inventors: Hans-Peter Seng, Reiskirchen (DE); Johann Reindl, Biebertal (DE); Thomas Schmidt, Haverlah (DE); Heinrich Niewoehner, Braunschweig (DE); Andreas Gebert, Braunschweig (DE)

(73) Assignees: Newfrey LLC, Newark, DE (US); Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 12/855,451

(22) Filed: Aug. 12, 2010

(65) Prior Publication Data

US 2011/0053434 A1 Mar. 3, 2011

Related U.S. Application Data

(63) Continuation of application No. PCT/EP2009/000942, filed on Feb. 11, 2009.

(30) Foreign Application Priority Data

Feb. 13, 2008 (DE) ..... 10 2008 010 352

(51) Int. Cl.
*H01R 4/30* (2006.01)

(52) U.S. Cl. ..... 439/793; 439/792

(58) Field of Classification Search ..... 439/790–793, 439/801, 883

See application file for complete search history.

(56) References Cited

U.S. PATENT DOCUMENTS

| | | | | |
|---|---|---|---|---|
| 4,410,226 | A * | 10/1983 | Adduci et al. | 439/142 |
| 4,832,629 | A * | 5/1989 | Sasaki et al. | 439/792 |
| 5,292,264 | A * | 3/1994 | Blank | 439/813 |
| 6,027,382 | A | 2/2000 | Reindl et al. | |
| 6,042,431 | A * | 3/2000 | Hayakawa | 439/801 |
| 7,281,962 | B2 * | 10/2007 | Dolzer et al. | 439/883 |
| 2005/0210670 | A1 | 9/2005 | Gourash et al. | |
| 2006/0239794 | A1 | 10/2006 | Dolzer et al. | |
| 2008/0014789 | A1 | 1/2008 | Matsuoka et al. | |

FOREIGN PATENT DOCUMENTS

| | | |
|---|---|---|
| DE | 101 55 644 A1 | 5/2003 |
| DE | 10 2004 054 782 B3 | 6/2006 |
| EP | 0 603 872 A2 | 6/1994 |
| EP | 1 923 957 A2 | 5/2008 |

* cited by examiner

*Primary Examiner* — Michael Zarroli

(74) *Attorney, Agent, or Firm* — Harness, Dickey & Pierce, P.L.C.

(57) ABSTRACT

The invention relates to a holding arrangement for at least two electrical connection elements, such as cable lugs, for example, which each have an electrical connection section and a line section, with a base part and a cover part, which can be connected to the base part to form the holding device, the connection sections being inserted axially one on top of the other in the holding device and being fixed axially, and the line sections extending in the radial direction from radial openings of the holding device, the radial openings being designed in such a way that the connection sections cannot be withdrawn from the radial openings, in addition an axial opening being formed on the base part and/or the cover part, via which axial opening electrical contact can be made with at least one connection section of the inserted connection sections, the holding device having centering means for centering the connection sections in the holding device, and the centering means acting on the outer circumference of the connection sections.

19 Claims, 4 Drawing Sheets

RETAINING DEVICE FOR CABLE LUGS

CROSS-REFERENCE TO RELATED APPLICATIONS

This application is a continuation of copending international patent application PCT/EP2009/000942 filed on Feb. 11, 2009 and designating the U.S., which claims priority of German patent application 10 2008 010 352.7 filed on Feb. 13, 2008. The entire contents of these applications are incorporated herein by reference.

BACKGROUND OF THE INVENTION

The present invention relates to a holding arrangement for at least two electrical connection elements, such as cable lugs, for example, which each have an electrical connection section and a line section.

In addition, the present invention relates to a fitting apparatus for equipping such a holding arrangement and to a method for installing a ground contact between a ground bolt, which is attached to a mount such as a metal sheet, and at least one cable lug. The method for installing the ground contact should in this case preferably be carried out using a holding arrangement of the type mentioned above.

In general, the present invention is concerned with the field of so-called ground contacts, as are in widespread use in particular in motor vehicle technology. In order to install a stable ground contact, a bolt or a nut is welded onto a metal sheet of a vehicle chassis, so that the bolt or the nut is electrically conductively connected to the metal sheet. Then, a connection part such as a cable lug is electrically connected to the bolt or to the nut by a nut being screwed onto the bolt or a screw being screwed into the nut.

It is often necessary to attach a plurality of cable lugs to one ground bolt. The fitting complexity involved here is relatively great. In addition, there is the risk of a cable lug of a cable harness, which is supplied by a cable harness manufacturer, being forgotten during the final fitting on the ground bolt. It is known from the prior art to combine the cable lugs of a cable harness, with which contact is to be made on a single ground bolt, in a holding arrangement as early as when the cable harness is produced. For example, document EP 0 895 305 A1 has disclosed such a holding arrangement, which has a cylindrical cage and a press-on element, which is axially prestressed by means of a spring in the cage. The cable lugs are inserted from above at an angle between an axial inner side of the cage and the press-on disc in such a way that the line sections of the cable lugs protrude out of radial openings. The production of such a holding arrangement is comparatively complex, however.

Document DE 10 2004 054 782 B3 proposes a fitting preparation system for fitting cable lugs on a bolt. The fitting preparation system contains a distribution box, in which connection tongues of the cable lugs are inserted. In addition, a fitting aid is temporarily connected to the distribution box, which fitting aid has a protruding centering element. In terms of cross section, the centering element corresponds to the cross section of the ground bolt and thereby centers the cable lugs by the centering element passing through the connection openings of the cable lugs. When this holding arrangement is fitted on the ground bolt, the fitting aid is pushed out by means of the bolt and is then disposed of.

SUMMARY OF THE INVENTION

Against the above background, the object of the invention is to provide an improved holding arrangement for connection elements such as cable lugs, an improved fitting device for such a holding arrangement and an improved method for installing a ground contact between a ground bolt and at least one cable lug.

The object is firstly achieved by a holding arrangement for at least two electrical connection elements, such as cable lugs, for example, which each have an electrical connection section and a line section, with a base part and a cover part, which can be connected to the base part to form a holding device, the connection sections being inserted axially one on top of the other in the holding device and being fixed axially, and the line sections extending in the radial direction from radial openings of the holding device, the radial openings being designed in such a way that the connection sections cannot be withdrawn from the radial openings, in addition an axial opening being formed on the base part and/or the cover part, via which axial opening electrical contact can be made with at least one connection section of the inserted connection sections, the holding device having centering means for centering the connection sections in the holding device, and the centering means acting on the outer circumference of the connection sections.

The above object is also achieved by a fitting apparatus for equipping such a holding arrangement, with a centering bolt, onto which the base part is positioned in the axial direction, and with positioning means, which ensure, by interacting with a positioning device of the base part, a positionally correct rotary position of the base part in relation to the centering bolt, and the fitting apparatus having anti-rotation means, which prevent a rotation of the base part in relation to the centering bolt.

In addition, the above object is achieved by a method for installing a ground contact between a ground bolt, which is attached to a mount such as a metal sheet, and at least one cable lug, having the following steps:

a) provision of a base part and axial insertion of the cable lug into the base part;
b) closure of the base part by means of a cover part in such a way that the cable lug is accommodated in the holding device thus formed in such a way that it is pre-vented from becoming detached;
c) positioning of the holding device onto the ground bolt, the ground bolt passing through axial openings in the base part and the cover part and a connection opening, which is aligned therewith, of the cable lug, and the cable lug making electrical contact with the ground bolt; and
d) screwing of a nut onto the ground bolt, the nut making electrical contact with the cable lug or a further cable lug which is arranged above it, and the holding device remaining on the ground contact thus formed.

The holding arrangement according to the invention has the advantage that the connection sections, which are held in the holding device in such a way that they cannot become detached, of the connection elements are centered by centering means, which act on the outer circumference of the connection sections. Centering via a disposable part is therefore not required. Instead it is possible for the holding device to remain on the ground contact once the ground contact has been installed. This means that no waste products are produced in the fitting process.

The base part and the cover part can be produced, for example, from plastic and consequently in a cost-effective manner.

In accordance with a preferred embodiment, the connection sections are each in the form of flat tongues (such as a cable lug, for example), a resting face being formed for each tongue on the base part and/or on the cover part.

This makes it possible to associate a predetermined axial position with each connection section in the holding device. Consequently it is possible to fix cable lugs, which are associated with specific functions, in each case at the same position within the holding device. This makes it possible, for example, to provide a large number of different cable runs, it being possible for the cable lugs, whose functions in the cable runs are in each case identical, to be fitted in each case at the same position. The cable lugs consequently do not necessarily need to be positioned axially directly one on top of the other. For example, an electrical ground contact with an upper cable lug via the nut and an electrical ground contact with a lower cable lug via a flange of a ground bolt can be produced, these cable lugs not necessarily needing to be in contact with one another. However, preferably all of the cable lugs in the holding device are in contact with one another.

In this case it is particularly advantageous if the resting faces have axially different heights, whose distance from one another corresponds to the thickness of a tongue.

This makes it possible in a simple manner to assign in each case one defined axial position within the holding device to the cable lugs. The axially different heights of the resting faces can be realized easily in particular in the case of injection-molded parts.

In addition it is advantageous if press-on sections are formed on the other part, which press-on sections press the tongues against the resting faces when the holding device is closed.

In this way it is possible to fix the axial position of the respective tongues within the holding device, even if only one or fewer than the maximum number of connection elements is inserted into the holding device.

It is advantageous in this case if the press-on sections have axially different heights, these heights being matched in each case to the heights of the associated resting faces.

Overall, it is also advantageous if the base part and the cover part can only be connected to one another in a specific rotary position relative to one another.

Firstly, a clear assignment between the resting faces and the press-on sections is thereby possible. Secondly, it is possible to form markings on the base part and on the cover part which identify the respective positions of certain cable lugs, for example by means of the formation of numbers or the like. Consequently, it is possible in a simple manner to establish, first during fitting and in the case of a finished ground contact, which cable lug is arranged in a specific position of the holding device.

A further preferred embodiment provides that the centering means for at least one connection section are formed on the base part.

In this way, the centering of this connection section can be realized in a simple manner in design terms. This is particularly the case for a connection section or connection sections which are the first ones to be inserted into the base part.

In accordance with a further embodiment, the centering means for at least one connection section are formed on the base part and on the cover part.

In this embodiment, the centering can be realized in a likewise favorable manner. This is particularly the case for the upper ones of a plurality of connection sections inserted into the base part.

In addition, it is advantageous if the centering means for at least one connection section have a face on the inner circumference of the axial opening of the base part.

In this case, the axial opening or a section thereof can also fulfill a centering function.

Overall, it is additionally preferred if the centering means for at least one connection section have two axially protruding projections on the base part and/or on the cover part, which form the radial opening for the associated line section.

In this case, the centering on the outer circumference of the connection sections preferably takes place via three bearing faces or bearing points, of which two are formed in the region of the lateral edges of the radial opening. The third bearing section for centering purposes can then be formed on one side of the holding device, which side is opposite the radial opening.

This may be, for example, a face on the inner circumference of the axial opening of the base part and/or the cover part.

It is particularly preferred if the centering means for at least one connection section have an axially protruding centering projection on the base part and/or on the cover part, the centering projection being arranged on one side of an axial opening of the base or cover part, which side is opposite the radial opening for the associated line section.

Accordingly, the bearing point, which is opposite the radial opening, of the outer circumference centering can be formed on the base part or on the cover part. The other two bearing points are preferably formed for all of the connection elements on the other part (preferably the base part).

In accordance with an overall preferred embodiment, the connection sections each have a connection opening, both the base part and the cover part each having an axial opening, which is radially aligned with the connection openings.

In this way, centering of the connection openings in relation to the axial openings of the cover part and the base part can also be realized.

Overall, it is also preferred if the base part and/or the cover part has an anti-rotation device.

Such an anti-rotation device allows for positioning of the holding device in relation to the ground bolt which is fixed against rotation, with the result that a rotation of the connection elements is ruled out when the ground contact is installed by means of a nut being screwed on.

It is particularly advantageous in this case if the anti-rotation device is formed by a configuration of the inner circumference of the axial opening which is different than a circular form.

This configuration can be, in particular, a polygon such as an octagon, to be precise so as to match, for example, such a polygonal outer circumference of a flange section of the ground bolt.

In addition, it is overall preferred if the base part and/or the cover part has a positioning device, which allows for clear positioning of the part in relation to a fitting device.

This configuration makes it possible to position the holding device when fitting it with connection elements in a predetermined rotary position in relation to the fitting device, with the result that a clear assignment of specific cable lugs to specific circumferential positions of the holding device is possible.

It is particularly advantageous if the positioning device is formed on a side of the base part which is remote from the cover part.

As a result, the positioning device can be realized in a simple manner in design terms, for example by an eccentrically arranged cutout on the underside of the base part.

In accordance with an overall preferred embodiment, the base part and/or the cover part has a receptacle, into which at least one additional connection element can be inserted from outside the closed holding device.

This embodiment makes it possible in a simple manner to provide, retrospectively, an additional connection element on an already installed ground contact. Preferably, the receptacle is therefore formed on the cover part, so that, once a nut of the ground contact has been unscrewed, the retrospective insertion of the additional connection element into the receptacle of the holding device and the subsequent tightening of the nut again is possible.

Overall it is preferred if the base part and the cover part are detachably connected to one another.

In this embodiment it is possible to carry out retrospective equipping of the holding device, in particular if no receptacle for an additional connection element is provided.

In accordance with a further overall preferred embodiment, the base part and the cover part can be connected to one another via latching means.

In this embodiment, the holding device can be closed in a simple manner. A special tool is in this case not required.

In accordance with a further overall preferred embodiment, the cover part is designed to be integral with the base part, in particular via a film hinge. In this embodiment, the cover part and the base part can be formed from plastic. In addition, it is possible to provide the cover part and the base part as a single component, with the result that warehousing costs, etc. are reduced.

Overall, depending on the embodiment described above, at least one of the following advantages is achieved by the present invention.

There is provided a preassembly process which is reliable on the cable harness suppliers premises.

The size of the holding device can be designed to be at a minimum.

It is possible to realize an anti-rotation system for the holding arrangement in relation to a ground bolt, for example by means of an octagonal configuration of a flange section of the ground bolt.

The holding device can be designed to accommodate at least five cable lugs, in particular six cable lugs.

A preassembly process is provided which involves reliable transport results. A change in position of the cable lugs is impossible.

In addition, the cable lugs are centered in the holding arrangement for the purpose of simple final assembly.

The transport securing means and the centering securing means can be realized without any disposable parts.

It goes without saying that the features mentioned above and yet to be explained below can be used not only in the respectively given combination, but also in other combinations or on their own without leaving the realms of the present invention.

BRIEF DESCRIPTION OF THE DRAWINGS

Exemplary embodiments of the invention are illustrated in the drawing and will be explained in more detail in the description below. In the drawing.

DETAILED DESCRIPTION OF PREFERRED EMBODIMENTS

Figure 1:
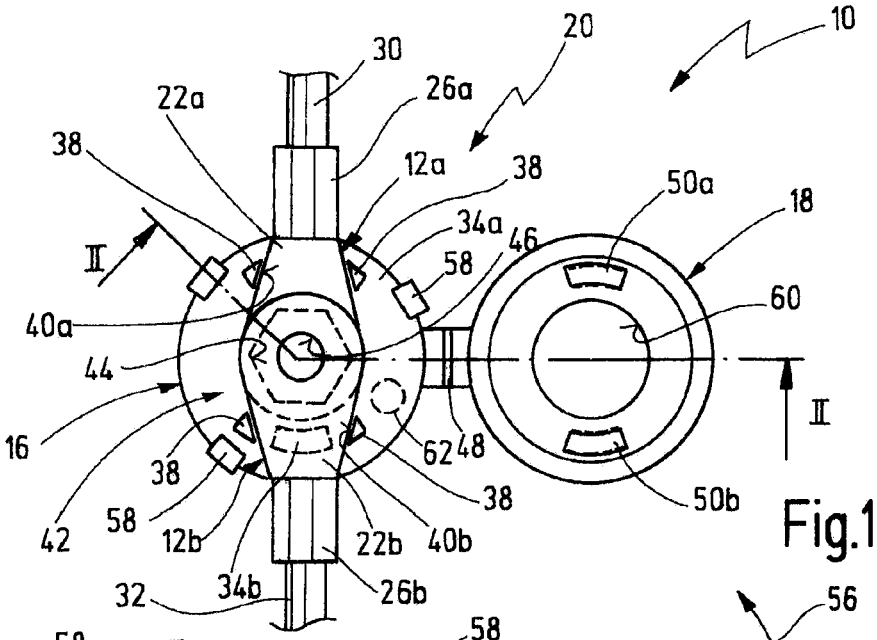
FIG. 1 shows a schematic plan view of a holding arrangement in accordance with one embodiment of the present invention.
Figure 2:
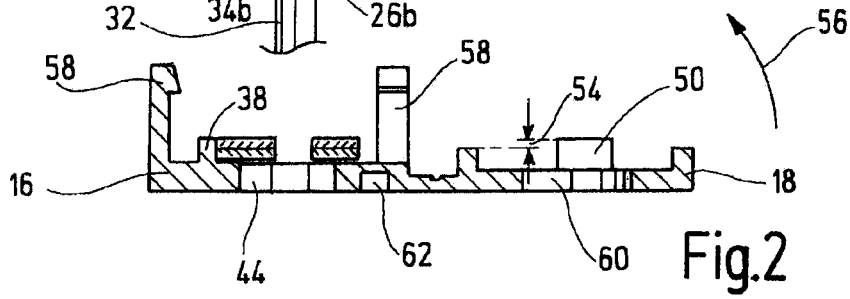
FIG. 2 shows a schematic sectional view along the line II-II in FIG. 1.

In FIGS. 1 and 2, a first embodiment of a holding arrangement according to the invention is generally denoted by 10.

The holding arrangement serves the purpose of holding one or two cable lugs 12 (in the illustrated case two cable lugs) and has a base part 16 and a cover part 18. The base part 16 and the cover part 18 are shown in an open state, the cable lugs 12*a*, 12*b* having been inserted axially into the base part. The base part 16 and the cover part 18 each have an approximately circular outer circumference and, in the closed state, form a holding device 20, in which the inserted cable lugs 12 are held securely. The cable lugs 12*a*, 12*b* each have a metallic connection section or tongue 22*a*, 22*b* and a line section 26*a*, 26*b*, which adjoins the connection tongue. The line sections 26*a*, 26*b* are connected to a first electrical cable 30 and a second electrical cable 32, respectively. The cables 30, 32 can be part of a cable run.

The base part 16 has a first resting face 34*a*, on which the connection tongue 22*a* rests flat. In a corresponding manner, the base part 16 has a projection, which protrudes by the height of the connection tongue 22*a* and whose upper side forms a second resting face 34*b*.

In addition, a plurality of axial projections 38 protrude with respect to a base face of the base part 16. The axial projections 38 define a first radial opening 40*a* for the first cable lug 12*a* and a second radial opening 40*b* for the second cable lug 12*b*.

In addition, the holding device 20, which is formed from the base part 16 and the cover part 18, has centering means 42, in order to centre at least one of the cable lugs 12*a*, 12*b* in the closed holding device 20.

The centering in this case takes place in such a way that central connection openings 46 of the connection tongues 22 are aligned with one another and with an axial opening 44 of the base part 16.

The holding device 20 also has a film hinge 48, via which the base part 16 and the cover part 18 are integrally connected to one another.

A first press-on projection 50*a* and a second press-on projection 50*b*, which have axially different heights, are provided on the cover part 18. The first press-on projection 50*a* is shaped in such a way that it presses an upper side of the first connection tongue 22*a* against the associated resting face 34*a* when the holding device 20 is closed. In a corresponding manner, the second press-on projection 50*b* is designed to press the second connection tongue 22*b* against the second resting face 34*b*.

The difference in height between the two press-on projections 50*a*, 50*b* in turn corresponds to the thickness of a connection tongue 22 and is shown schematically in FIG. 2 at 54.

In addition, FIG. 2 shows the folding direction, along which the cover part 18 can be folded onto the base part 16 about an axis of the film hinge 48 which is arranged tangentially with respect to the outer circumference of the base part 16.

In addition, latching projections 58 are provided on the base part 16 which engage in latching fashion behind an upper side of the cover part 18 once the cover part 18 has been folded onto the base part 16.

The dimensions of the latching projections 58 are matched to the dimensions of the press-on projections 50*a*, 50*b* and the resting faces 34*a*, 34*b*, with the result that, in the latched-in state, the axial position of the connection tongues 22*a*, 22*b* within the holding device 20 is in each case fixed individually. The centering means 42 also ensure that the connection tongues 22*a*, 22*b* are centered in relation to the axial opening 44 in the base part 16 and in addition in relation to an axial opening 60, which is formed concentrically with respect to the axial opening 44, of the cover part 18.

Consequently, when the holding device 20 is closed, electrical contact can be made with a lower cable lug via the axial opening 44 in the base part 16. Electrical contact can be made with an upper cable lug via the axial opening 60 in the cover part 18.

The diameters of the axial openings 44, 60 are consequently larger than the diameters of the connection openings 46 of the connection tongues 22.

In addition, a positioning device 62 in the form of an eccentrically arranged cutout on the underside of the base part 16 is shown in FIGS. 1 and 2. As a result of the positioning device 62, it is possible to position the base part 16 with a clear rotary position in relation to a fitting device, as will be described below. In addition, the inner circumference of the axial opening 44 of the base part 16 is designed to be different from a circular form, in the present case in the form of an octagon. However, it is also possible to provide a different polygon face or another inner circumference face of the axial opening 44 which differs from the circular shape, such as a toothed formation or the like, for example. The configuration of the axial opening 44 provides an anti-rotation device and is preferably matched to the design of the outer circumference of a flange section of a ground bolt, on which the holding device 10 (i.e. the holding device 20 with the cable lugs 12 fitted) can be fitted in order to form a ground contact.

If, in the context of the present application, mention is made of a ground contact, it goes without saying that another electrical contact (for example a positive terminal or the like) can also be realized by means of the holding device 10 according to the invention.

The holding device 10 is designed to be positioned onto a ground bolt, the electrical contact being made via a nut, which is screwed onto the ground bolt. In this case, the nut makes contact with an uppermost cable lug and the lowermost cable lug makes contact with a flange section of the ground bolt. The holding device 20 including the base part 16 and the cover part 18 can in this case remain on the ground contact, the nut being screwed onto the ground bolt through the axial opening 60 in the cover part 18, which ground bolt passes through the connection openings 46 of the connection tongues 22.

Figure 3:
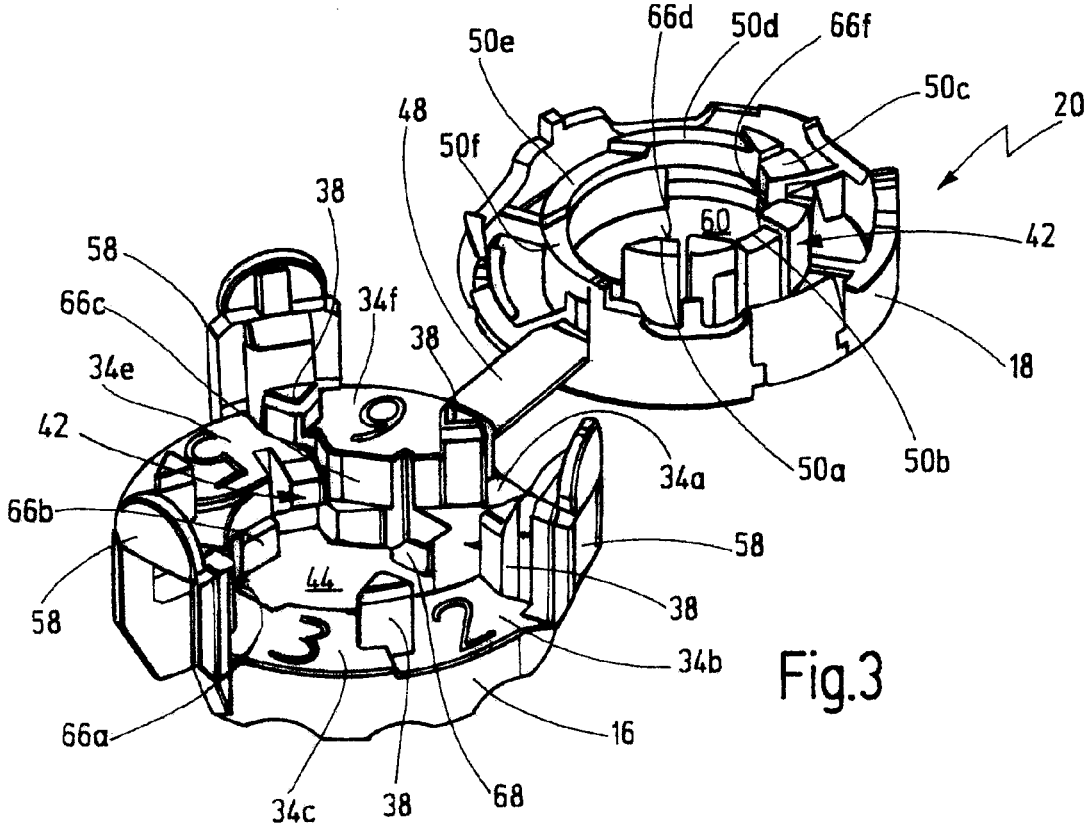
FIG. 3 shows a perspective arrangement of an open holding device of a holding arrangement according to the invention in accordance with a further embodiment.

FIG. 3 is a perspective illustration of a holding arrangement for a further embodiment of a holding arrangement according to the invention. The holding device 20 corresponds in terms of design and function generally to the above described holding device in FIGS. 1 and 2. In the text which follows, only the differences will be explained.

The holding device 20 in FIG. 3 has six resting faces 34*a*, . . . , 34*f* distributed over the circumference, with the result that the holding arrangement 10 can be equipped with in total six cable lugs 12*a*, . . . , 12*f*.

The resting faces 34*a*, . . . , 34*f* each have an axially different height, the height rising gradually in the circumferential direction. In a corresponding manner, the cover part 18 has six press-on projections 50*a*, . . . , 50*f*, whose axial height is likewise different. In this case, the fifth press-on projection 50*a* corresponds to the lowermost resting face 34*a*.

Three of the press-on projections are in this case designed in such a way that they protrude inwards in a radial direction slightly with respect to the axial opening 60. In this case, these press-on projections 50*a*, 50*b*, 50*c* are designed to have slots in the longitudinal direction in order to realize elasticity in the radial direction. Consequently, a nut, when screwed in through the axial opening 60, can push the slightly inwardly protruding press-on projections 50*a*, 50*b*, 50*c* away radially towards the outside.

The centering means 42 of the holding device 20 in FIG. 3 are designed in such a way that contact is made with each inserted connection tongue 22 at three points circumferentially on the outside in order to achieve centering. Two of the bearing sections are in this case formed in each case by the axial projections 38, between which the radial openings 40 are formed. On the side opposite the axial opening 44, in each case one third bearing section is then provided for centering purposes. This third bearing section is formed for the connection tongues, which are inserted at positions 1, 2, 3, by radial stops 66*a*, 66*b*, 66*c*, which are provided on the inner circumference of the axial opening 44. The radial stops 66*d*, 66*e*, 66*f* for the connection tongues in the positions 4, 5 and 6 are formed by radially inner faces of the press-on projections 50*a*, 50*b*, 50*c*.

It can furthermore be seen in FIG. 3 that at least one bolt latching tab 68 protrudes beyond the inner circumference of the axial opening 44. The bolt latching tab 68 is arranged in the region of the underside of the base part 16 and serves the purpose of engaging behind a flange section of a ground bolt or a centering bolt when the latter is fitted. In other words, the holding device 20 can be fixed axially on a ground or centering bolt by means of the bolt latching tab 68.

Figure 4:
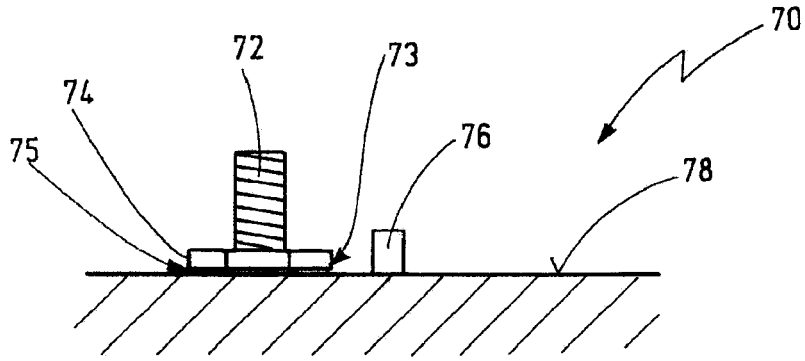
FIG. 4 shows a schematic side view of a fitting device according to the invention.

FIG. 4 shows, in a schematic form, a fitting device 70 for equipping a holding device 20. The fitting device 70 has a centering bolt 72, which has a similar shape to a ground bolt which has been welded to a vehicle chassis. The centering bolt 72 has a flange section 73, whose outer circumference is in the form of a hexagon or octagon. The circumference of the flange section 73 consequently forms an anti-rotation means 74, which is designed to come into engagement with the anti-rotation device of the holding device 20 (i.e. the inner circumference of the axial opening 44). In addition, a latching opening 75 is formed between an underside of the flange section 73 and an upper side of a fitting surface 78, into which latching opening 75 the bolt latching tab 68 (or the plurality of bolt latching tabs 68) can engage in latching fashion.

Laterally next to the centering bolt 72, a positioning means 76 in the form of a pin protruding from the fitting surface 78 is provided. The positioning means 76 engages in the positioning device 62 on the underside of the base part when the base part 16 is fitted, with the result that the base part 16 can only be fixed in latching fashion on the centering bolt 72 in a specific rotary position in relation to said centering bolt.

The equipping of the holding device 20 in FIG. 3 takes place by means of such a fitting device 70.

Figure 5:
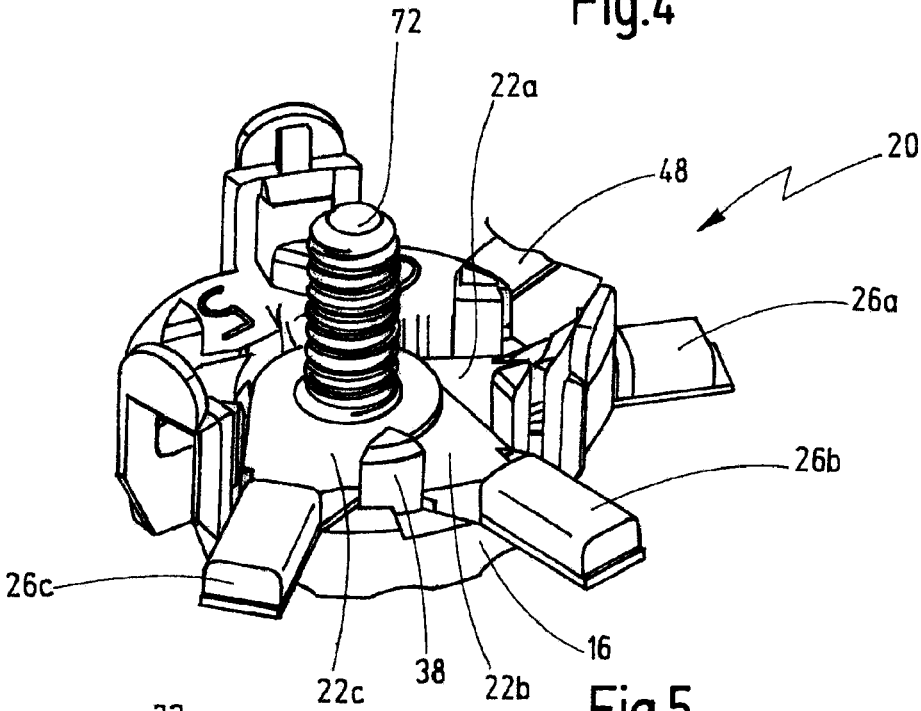
FIG. 5 shows the base part of the holding device in FIG. 3 once it has been equipped with two cable lugs.

FIG. 5 in this case shows, for example, the fact that cable lugs with connection tongues 22*a*, 22*b*, 22*c* have already been inserted at the fitting positions 1, 2 and 3.

Figure 6:
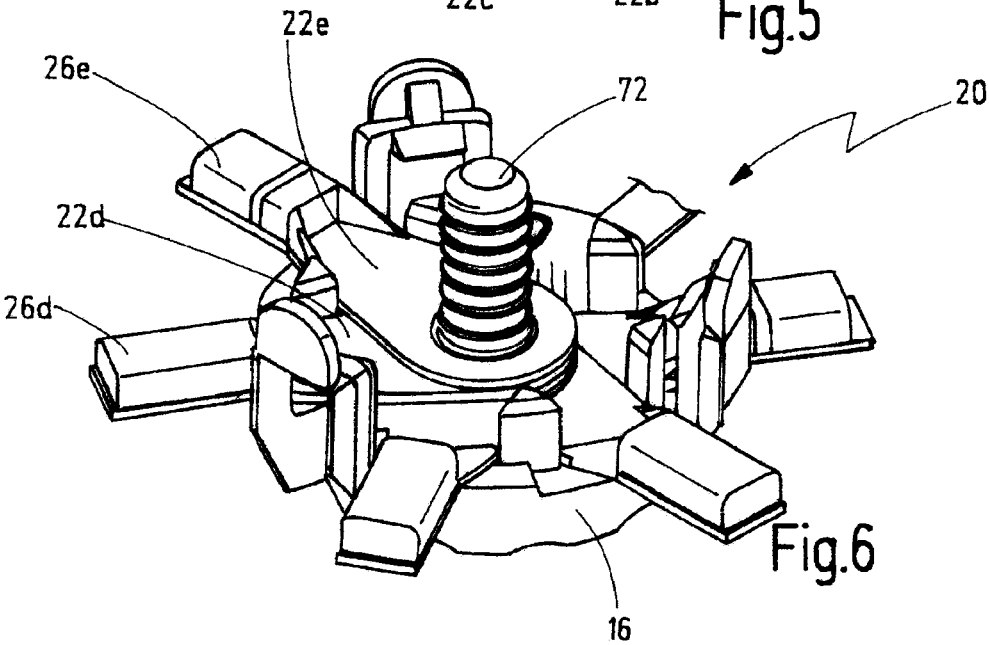
FIG. 6 shows an illustration corresponding to FIG. 5 with it being equipped with four cable lugs.

FIG. 6 shows a further fitting state, in which in addition also cable lugs with connection tongues 22*d*, 22*e* are inserted.

While the connection tongues 22*a*, 22*b*, 22*c* can already be centered by means of the base part 16, the intermediate centering of the further connection tongues 22*d*, 22*e* takes place by means of the centering bolt 72.

In a final fitting step, the cover part 18 is folded onto the base part 16 and connected to it in latching fashion in order to form the closed holding device 20. In this case, the inserted cable lugs 12 are held in the holding device 20 in such a way that they cannot become detached. As a result of the press-on projections of the cover part 18, the upper connection tongues 22*d*, 22*e* are now also centered, with the result that the holding arrangement 10 formed in this way can be removed from the centering bolt 72.

Figure 7:
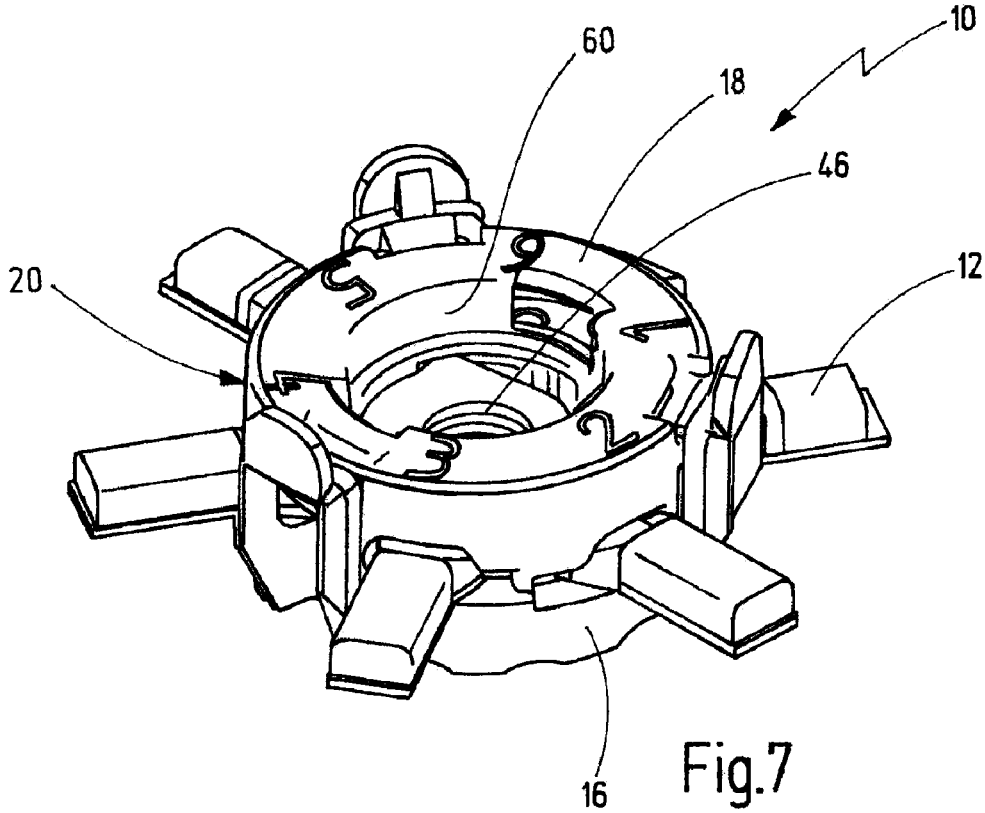
FIG. 7 shows the holding arrangement in FIG. 3 with the holding device closed and with it being equipped with five cable lugs, in a fitted state.

In the state shown in FIG. 7, the holding arrangement 10 can be connected, for example, to a cable run, which can then be supplied together with the holding arrangement 10 at a final assembly location. During this transport, the cable lugs 12 which have been inserted into the holding arrangement 10 are held so that they cannot become detached and in this case are fixed both in the axial direction and in the radial direction, i.e. also centered.

Figure 8:
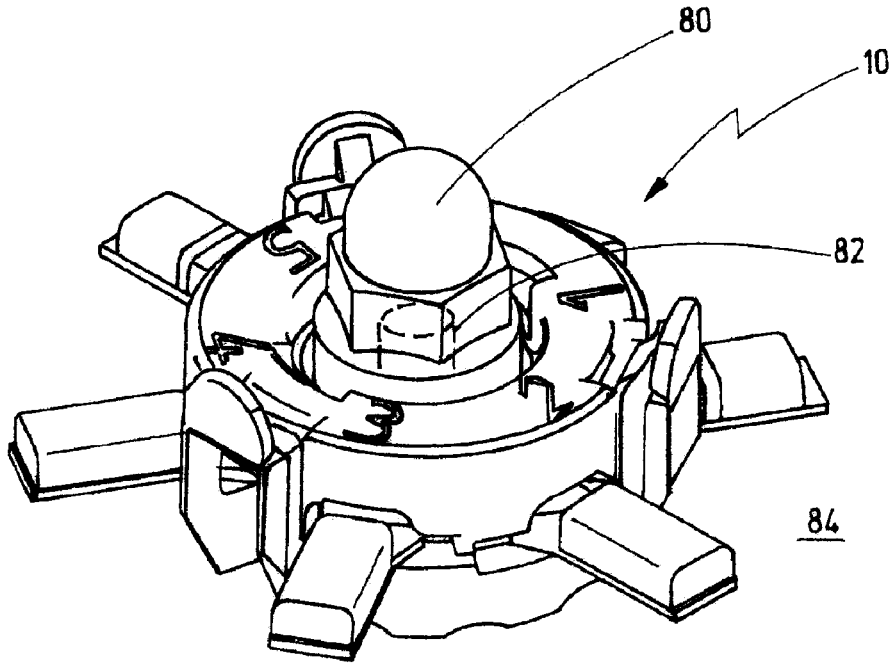
FIG. 8 shows an illustration of a ground contact with the holding arrangement in FIG. 7.

During final assembly, the holding arrangement 10 can then be positioned onto a ground bolt 82, as is illustrated schematically in FIG. 8. The ground bolt 82, which can be formed on a vehicle chassis, for example, corresponds in terms of its shape to the centering bolt 72. Consequently, the bolt latching tab 68 can engage behind the flange section of the ground bolt which is not shown in FIG. 8 and can initially be temporarily fixed on the ground bolt. Then, a nut 80 can be screwed onto the ground bolt 82, whose underside makes contact with the uppermost connection tongue 22*b*. Contact is made with the underside of the lowermost connection tongue 42*a* in this case from the upper side of the flange section of the ground bolt 82.

FIG. 8 schematically illustrates, at 84, a metal sheet, onto which the ground bolt 82 can be attached, in particular in the course of stud welding. The ground bolt 82 preferably has a coarse thread. The centering bolt 72 does not need to have a thread, but can have a thread, as is illustrated in FIGS. 5 and 6.

Figure 9:
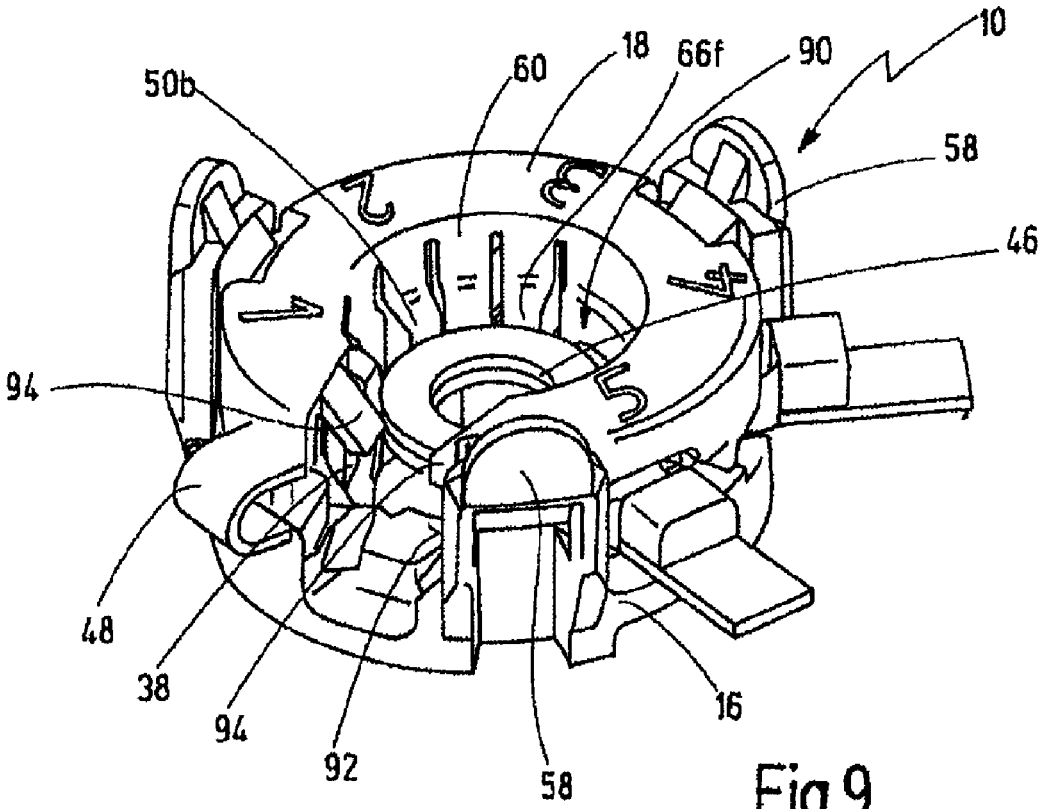
FIG. 9 shows a modification of the holding arrangement in FIG. 2 in the closed state.
Figure 10:
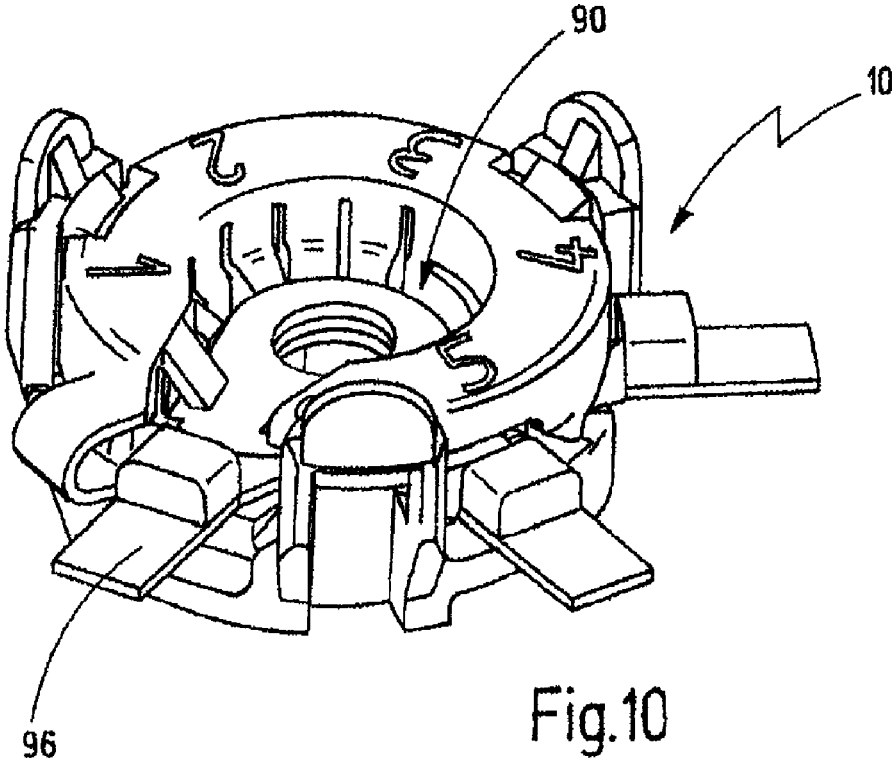
FIG. 10 shows a view corresponding to FIG. 9 after the insertion of an additional cable lug.

FIGS. 9 and 10 show a modified form of a holding device 10. In this case, the holding device has a cover part 18, which has a receptacle, which is accessible axially from the outside, for a cable lug which is to be attached additionally or retrospectively.

The shape of the receptacle 90 corresponds to the shape of the receptacles for the connection tongues of the cable lugs 12 arranged in the holding device 10. In addition, a radial opening 92, which is open axially towards the top and via which the line section 26 of the additional cable lug can extend, is formed on the cover part 18. Latching tabs 94 are formed in the region of the radial opening 92 and can engage behind a line section 26 of an additional cable lug which has been inserted.

Consequently, as is shown in FIG. 10, a holding arrangement 10 which has already been fitted on a ground bolt (not shown in FIG. 10) can be supplemented by an additional cable lug 96 being inserted into the receptacle 90 once the nut 80 has been unscrewed. The additional cable lug in this case makes contact with the uppermost cable lug, which is arranged within the holding arrangement 10. Then, the nut 80 can be screwed on again in order to complete the ground contact in this way.

What is claimed is:

1. A holding arrangement for at least two electrical connection elements, which each have an electrical connection section and a line section, the holding arrangement comprising:

a base part having a positioning device which allows clear positioning of the electrical connection elements with respect to the holding arrangement;

a cover part connected to the base part to form the holding arrangement, the electrical connection section of each electrical connection element being inserted axially one on top of the other in the holding arrangement and being fixed axially, and the line sections extending in the radial direction from radial openings defined by the holding arrangement, wherein the radial openings are configured such that the electrical connection sections cannot be withdrawn from the radial openings, and wherein the positioning device is remote from the cover part; and an axial opening being defined by one of the base part and the cover part; the holding arrangement having a means for centering the connection sections in the holding arrangement, the means for centering acting on the outer circumference of the electrical connection sections.

2. The holding arrangement according to claim 1, the electrical connection sections each being in the form of flat tongues, said flat tongues coupled to the means for centering.

3. The holding arrangement according to claim 2, the resting faces having axially different heights, whose distance from one another corresponds to the thickness of a tongue.

4. The holding arrangement according to claim 1, the base part and the cover part only being capable of being connected to one another in a specific rotary position relative to one another.

5. The holding arrangement according to claim 1, the centering means for at least one connection section being formed on the base part.

6. The holding arrangement according to claim 1, the centering means for at least one connection section being formed on the base part and on the cover part.

7. The holding arrangement according to claim 1, the centering means for at least one connection section having a face on the inner circumference of the axial opening of the base part.

8. The holding arrangement according to claim 1, the centering means for at least one electrical connection section having two axially protruding projections on the base part and/or the cover part, which form the radial opening for the associated line section.

9. The holding arrangement according to claim 1, the centering means for at least one electrical connection section having an axially protruding centering projection on the base part and/or on the cover part, the centering projection being arranged on one side of an axial opening of the base or cover part, which side is opposite the radial opening for the associated line section.

10. The holding arrangement according to claim 1, the electrical connection sections each having a connection opening, and both the base part and the cover part each having an axial opening, which is aligned axially with the connection openings.

11. The holding arrangement according to claim 1, the base part and/or the cover part having an anti-rotation device.

12. The holding arrangement according to claim 11, the anti-rotational device being formed by a configuration of the inner circumference of the axial opening which differs from a circular form.

13. The holding arrangement according to claim 1, the base part and/or the cover part having a receptacle, into which at least one additional connection element can be inserted from outside the closed holding device.

14. The holding device according to claim 1, the base part and the cover part being detachably connected to one another.

15. The holding arrangement according to claim 1, the base part and the cover part being capable of being connected to one another via latching means.

16. The holding arrangement according to claim 1, the cover part being designed to be integral with the base part via a film hinge.

17. The holding arrangement according to claim 1, with a centering bolt, onto which the base part is positioned in the axial direction, and with positioning means, which ensure, by means of interacting with a positioning device of the base part, a positionally correct rotary position of the base part in relation to the centering bolt, the fitting apparatus having anti-rotation means, which prevent a rotation of the base part in relation to the centering bolt.

18. A holding arrangement for at least two electrical connection elements, which each have an electrical connection section and a line section, the holding arrangement comprising:

a base part;

a cover part connected to the base part to form the holding arrangement, the electrical connection section of each electrical connection element being inserted axially one on top of the other in the holding arrangement and being fixed axially, and the line sections extending in the radial direction from radial openings defined by the holding arrangement, wherein the radial openings are configured such that the electrical connection sections cannot be withdrawn from the radial openings; and an axial opening being defined by one of the base part and the cover part; the holding arrangement having a means for centering the connection sections in the holding arrangement, the means for centering acting on the outer circumference of the electrical connection sections, further including press-on projections, which press tongues against resting faces when the holding arrangement is closed.

19. The holding arrangement according to claim 18, the press-on projections having axially different heights.

* * * * *